United States Patent [19]

Ruddle et al.

[11] 4,131,152

[45] Dec. 26, 1978

[54] FEEDING UNIT FOR A CASTING

[75] Inventors: Ronald W. Ruddle, Cleveland, Ohio; Frank Neat, Elora, Canada

[73] Assignee: Foseco Trading AG, Switzerland

[21] Appl. No.: 755,703

[22] Filed: Dec. 30, 1976

[51] Int. Cl.[2] ..... B22C 9/08

[52] U.S. Cl. ..... 164/359; 164/53; 249/106; 249/197

[58] Field of Search ..... 164/53, 360, 359; 249/52, 106, 197

[56] References Cited

U.S. PATENT DOCUMENTS

| | | | |
|---|---|---|---|
| 960,372 | 6/1910 | Monnot | 249/106 |
| 961,854 | 6/1910 | Gathmann | 249/106 |
| 2,362,097 | 11/1944 | Rowe | 249/106 |
| 2,366,289 | 1/1945 | Rowe | 249/106 X |
| 2,867,871 | 1/1959 | Shephard, Jr. | 249/106 X |
| 3,288,424 | 11/1966 | Dean | 249/52 X |
| 3,672,433 | 6/1972 | Daussan | 249/106 X |

*Primary Examiner*—Robert L. Spicer, Jr.

*Attorney, Agent, or Firm*—Caesar, Rivise, Bernstein & Cohen, Ltd.

[57] ABSTRACT

A feeding unit comprising a breaker core and a riser sleeve. In a first embodiment the breaker core has a thickness of 10% of the diameter of the riser sleeve and the opening in the breaker core is from 20% to 35% of the riser sleeve diameter.

In another embodiment of the invention the breaker core opening is tapered inwardly and downwardly in a generally v-cross sectional shape and one embodiment of the invention will have a symmetrical v-cross sectional area.

1 Claim, 2 Drawing Figures

FEEDING UNIT FOR A CASTING

SPECIFICATION

Figure 1:
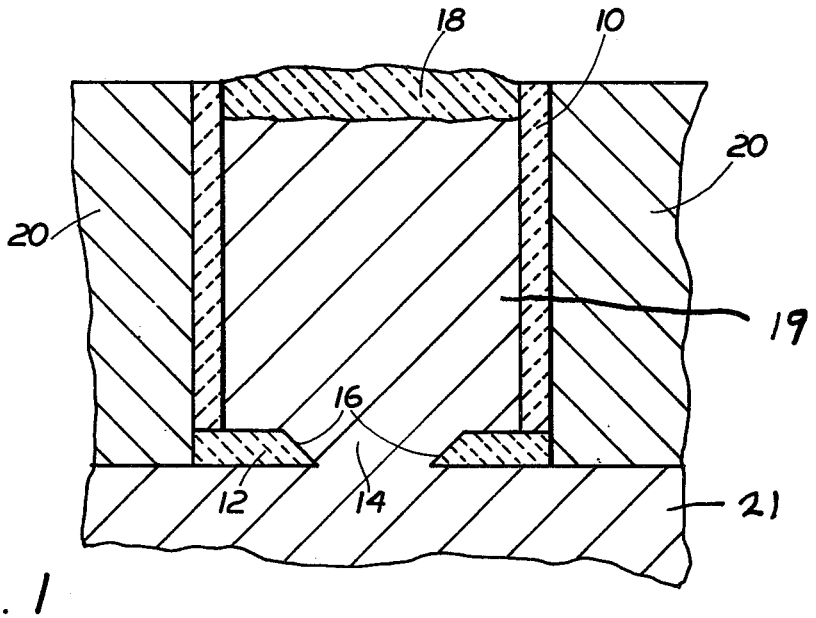

The invention relates to the feeding of castings and in particular, to a feeding unit basically comprised of a breaker core and a riser sleeve with a top cover. The invention also contemplates a method of feeding a casting.

It is known in foundry practice to superimpose on a casting cavity a reservoir of liquid metal through the use of a riser sleeve which is also called a metal head, feeding head or a sink head. Some of the liquid metal in the riser sleeve flows onto the mold cavity below to compensate for shrinkages in the casting body which occur on cooling and solidification. In older foundry practice, the riser sleeve was not insulated, but in recent years the riser sleeve has been comprised of a sleeve of heat insulating material or a sleeve of an exothermic insulating material or a combination of the two. In order to prevent the escape of heat from the upper surface of the riser, a top cover has been secured to the riser sleeve.

Where the riser sleeve is of insulating material, exothermic material or a combination of the two, the riser sleeve is of a smaller volume than when the riser sleeve is uninsulated. This is because an uninsulated sleeve must necessarily have a greater quantity of hot metal in the sleeve to provide sufficient heat to maintain the liquid state of the metal in the riser sleeve. In the case of heat generating or heat insulated riser sleeve, the diameter and volume can be smaller since the generated heat or insulation serves to minimize or substantially eliminate the heat loss.

One problem arising from the use of a riser sleeve is that upon solidification of a casting and removal from the mold, there remains attached to the casting an integral head or riser sleeve. It becomes necessary to crop off the riser contained within the riser sleeve and this is not only wasteful of metal, but is costly in terms of labor. Also, the process of removing the unwanted riser can damgage the casting or increase the problems of cleaning.

In order to facilitate the removal of the riser, it is frequently the practice to locate a breaker core at the base of the riser cavity. This is usually done by securing the breaker core to the mold or molding the preformed core into the mold. The breaker core is essentially a disc having an aperture. The breaker core functions to permit the flow of liquid metal as needed to compensate for casting shrinkage into the mold cavity, and also has the effect of reducing the contact area of the riser with the casting after solidification. The use of the breaker core in effect enables the achievement of a narrowed neck which constitutes a web joining the head from the riser to the body of the casting. This facilitates the removal of the riser which is achieved by a cutting or knocking off operation. Even after the removal of the riser, it is still necessary to clean or smooth the area exposed following removal of the head and in some cases a welding operation is required.

The practice has arisen in connection with insulated riser sleeves to make the diameter of the opening in the breaker core at least 40% of the diameter of the feeder head. This 40% or greater ratio is provided to avoid premature freezing of the metal in the riser sleeve to prevent inadequate feeding. Indeed some authorities regard 50% as the acceptable minimum figure. It has now been discovered according to the invention, that in the case of certain castings the opening in the breaker core may be from 25% to 35% of the feeder head diameter and sometimes as low as 20% without adverse consequence and with certain advantages.

Moreover, it is possible in accordance with the smaller opening of the breaker core of this invention to have a core thickness that is 15% or even down to 10% of the diameter of the riser sleeve. A core thickness of less than 10% is prohibited only by the resulting fragility arising from the use of materials presently available.

While the opening of the breaker core is preferably round, it may be non-round such as rectangular, oblong or triangular so long as there is an effective opening area in the range of 20% to 35% of the feeder head diameter.

According to this invention, there is provided a feeding unit comprising an insulated riser sleeve closed at the lower end by a breaker core wherein the diameter of the opening in the breaker core is from 25% to 35% of the diameter of the riser sleeve and at times as low as 20%. Moreover, the present invention contemplates that in view of the smallness of the breaker core opening, the thickness of the breaker core is less than 20% of the riser sleeve diameter and as low as 10% or even lower as allowed by considerations of fragility. Indeed, 10% is a preferred thickness.

According to a preferred feature of the invention, the casting contacting surface of the breaker core is usually flat except for the opening in the breaker core. However, the breaker core can be shaped to have an arcuate or curved lower surface in order to conform to the surface of the mold cavity.

The foregoing feeding unit may be used successfully to feed molten metal in the molding of castings having a ranginess factor (R factor) in excess of 2. The R factor is defined as the ratio of the surface area of a casting to the surface area of a cube the same volume. Thus, for a parallelepiped having a dimension of 1.25 inches by 40 inches by 20 inches, R factor is 2.92. This is calculated by taking the surface area of the parallelepied which is 1750 inches and comparing such surface area with a cube of the same volume (1000 cubic inches) that has a surface area of 600 square inches. Thus, the fraction of 1750 divided by 600 yields the R factor 2.92. Castings having a ranginess in excess of 2 tend to be shapes required in the railway or like industries, such as a railroad bolster.

Where the ranginess factor is 2 or greater, the casting tends to have a very quick freezing time, and thus any shrinkage will occur over a shorter period of time. With very high ranginess factors, it is possible to make the breaker core opening even smaller than 25% of the sleeve diameter in the case of most metals having small or average contraction or shrinkage upon cooling. This is because the relatively short solidification time requires the more rapid feeding of metal from the reservoir in the riser sleeve and also the shorter time gives less concern for any premature partial metal solidification in the sleeve. Thus, the smaller breaker core opening can be utilized. With the use of a small breaker core opening, there is only a small area exposed upon removal of the riser after solidification. Such removal is normally achieved by knocking off the riser with a hammer. Hence, the smaller the riser neck, the easier and cleaner is the removal process. With a smaller neck, there is also less area to smooth or clean and finish. There is also less chance of damage to the casting.

A typical insulated feeder head or riser is comprised of an insulated material that includes a phenol formaldehyde or urea formaldehyde binder resin. The sleeve may be made of fine powdered refractory materials, slag wool, high temperature ceramic fibers or paper. The breaker core may be made of foundry sand bonded with a resin such as phenol formaldehyde or with core oil. The top cover may be made of an insulating material or an exothermic insulating material. Examples of the foregoing materials and others can be found in U.S. Patents 3,326,273, 3,567,667 and 3,662,536.

In another aspect of the invention the opening in the breaker core is downwardly coverging to assist fracture and to insure that fracture takes place immediately at the surface of the casting leaving little or no protruding area after riser removal. Thus, the narrow neck and incline in breaker core opening facilitate fracture of the riser.

In a preferred embodiment of the invention, the wall defining the hole tapers inwardly and downwardly from the upper surface of the lower surface or from the surface contacted by the reservoir metal to the casting contacting surface. The cross-sectional area through the breaker core opening is generally a v-cross sectional shape. In another aspect of the invention the wall defining the breaker core opening tapers inwardly from the upper as well as the lower surface to meet in a point at the center to form a symmetrical v-cross sectional area or the meeting place can be at any point in between.

It is generally preferred to secure the breaker core to the riser sleeve using an adhesive or by other means.

Figure 2:
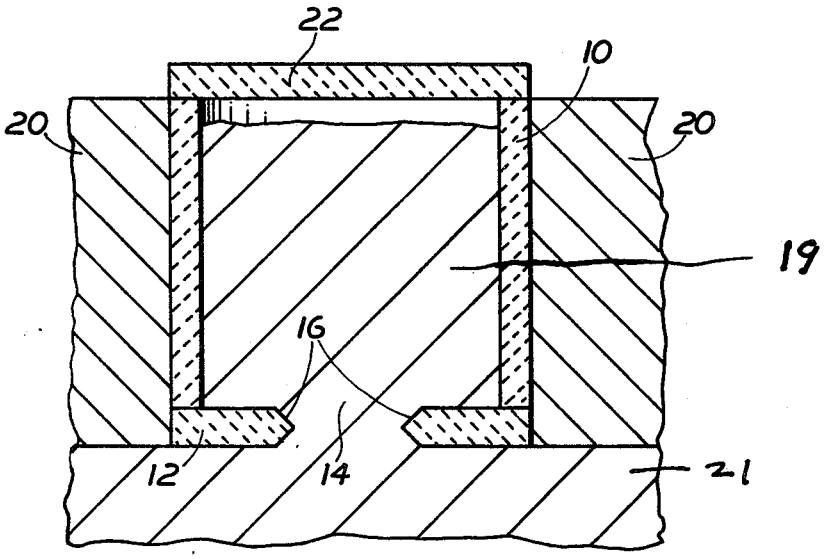

The invention is illustrated by the accompanying drawings wherein:

FIG. 1 is a sectional view of a first embodiment of the feeding unit of the present invention secured upon a casting cavity; and FIG. 2 is a sectional view, similar to FIG. 1, but showing another embodiment of the invention.

In the embodiment of FIG. 1 the riser sleeve 10 is formed of either an insulating material or an exothermic material or a combination of the two. For ease of reference in the attached claims the term "insulated riser sleeve" will be used to cover a riser sleeve of insulating material or exothermic material or a combination of the two. The breaker core 12 is bonded silica and having an opening 14. The core 12 is secured to the lower end of sleeve 10 using a polyvinyl acetate adhesive with a silica filler.

The parts of FIG. 1 are arranged concentrically and dimensioned so that the diameter of the opening 14 in the breaker core 12 is about 30% of the diameter of the riser sleeve 10. In a specific example the diameter of the breaker core opening is 1.25 inches and the diameter of the sleeve is 4 inches so the ratio is 31%.

The wall 16 of the opening 14 is downwardly converging so that the opening is flared as shown in FIG. 1 and wherein the casting contacting surface is flat except for the opening 14. The riser sleeve 10 is molded into or secured within an opening in the mold cavity 21 of FIG. 1.

Molten steel was poured into the riser cavity 19 in such a way as simultaneously to leave a reservoir of molten metal within the riser sleeve 10. A cover 18 of powdered exothermic material was then applied. Alternatively, a preformed cover 22 was used. After solidification, the head remaining within sleeve 10 was knocked off cleanly and quickly. While there was some irregular fracturing, such fracturing did not penetrate below the machining allowance of the casting and there was little need for post-casting operations such as welding, cleaning or "Arcair" washing. The cover 18 is of granular insulating or exothermic material that has been poured in place. The cover 22 is preformed.

Indeed, it was a simple operation to knock off the head because of the smaller web connecting the head to the body of the casting.

It should be kept in mind that with the present invention, the breaker core is secured to the riser sleeve, rather than in the prior art where the breaker core is secured to the mold.

In the embodiment of FIG. 2 the breaker core 12 has an opening 14 defined by side walls of a generally symmetrical v-cross sectional shape.

The invention is particularly suited for use in making castings having a ranginess factor in excess of 2.0 and is preferably used with metals having a short freezing range of 10° C and 20° C which harden by a skin-type mechanism such as steel or aluminum bronze alloy.

Without further elaboration the foregoing will so fully illustrate our invention that others may, by applying current or future knowledge, readily adapt the same for use under various conditions of service.

We claim:

1. In a feeding unit including a breaker core and an insulated riser sleeve for a casting mold in foundry practice, said riser sleeve having a given inside diameter, the improvements comprising providing an opening in said breaker core of a size from 20% to 35% of said diameter, said breaker core having an opening defined by walls which include inwardly toward said opening and said breaker core having a thickness of from 5% to 20% of said diameter, and said casting molds being defined to produce a casting having a ranginess factor (R factor) in excess of 2.

* * * * *